United States Patent [19]

Osawa et al.

[11] Patent Number: 4,698,287

[45] Date of Patent: Oct. 6, 1987

[54] PHOTOSENSITIVE MEMBER HAVING AN AMORPHOUS SILICON LAYER

[75] Inventors: Izumi Osawa, Ikeda; Isao Doi, Toyonaka; Toshiya Natsuhara, Amagasaki, all of Japan

[73] Assignee: Minolta Camera Kabushiki Kaisha, Osaka, Japan

[21] Appl. No.: 791,710

[22] Filed: Oct. 28, 1985

[30] Foreign Application Priority Data

Nov. 5, 1984 [JP] Japan ..... SHO59-232879

[51] Int. Cl.[4] ..... G03G 5/085

[52] U.S. Cl. ..... 430/57; 430/84; 430/95

[58] Field of Search ..... 430/57, 84, 85, 86, 430/95

[56] References Cited

U.S. PATENT DOCUMENTS 4,451,546 5/1984 Kawamura et al. ..... 430/57
4,490,450 12/1984 Shimizu et al. ..... 430/57
4,491,626 1/1985 Kawamura et al. ..... 430/69
4,592,982 6/1986 Saitoh et al. ..... 430/95

FOREIGN PATENT DOCUMENTS 56-150753 4/1980 Japan .

*Primary Examiner*—John L. Goodrow
*Attorney, Agent, or Firm*—Burns, Doane, Swecker & Mathis

[57] ABSTRACT

The invention disclosed relates to a photosensitive member which comprises a conductive substrate, a first amorphous silicon: germanium layer, an amorphous silicon layer formed on said first layer and having a thickness of about 10 to 100 μm and a second amorphous silicon: germanium layer formed on said amorphous silicon layer and having a thickness of less than about 4 μm. The photosensitive member of the present invention has improved sensitivity toward long wavelength light and excellent chargeability, and is free of residual potential and interference phenomena.

6 Claims, 4 Drawing Figures

PHOTOSENSITIVE MEMBER HAVING AN AMORPHOUS SILICON LAYER

BACKGROUND OF THE INVENTION

1. Field of the Invention

The present invention relates to a photosensitive member which has an amorphous silicon: germanium layer.

2. Description of the Related Art

Amorphous silicon: germanium (hereinafter referred to as a-Si:Ge), whose band gap is smaller than that of amorphous silicon (hereinafter referred to as a-Si), exhibits a high absorption characteristic toward long wavelength light. This enables many carriers to be generated to improve a sensitivity toward long wavelength light, so that a-Si:Ge is expected to be utilized as a photosensitive member for a printer with a semiconductor laser. Moreover, a high sensitivity in short wavelength region is retained to permit the application of the a-Si:Ge to plain paper copiers (hereinafter referred to as PPC) by regulating the emission spectrum of exposure lamps. In addition, the excellent characteristics of high absorption toward long wavelength light in the a-Si:Ge layer greatly improves disturbance of images caused by the interference of light which is frequently observed in conventional a-Si photosensitive members.

With these inherent features of the a-Si:Ge, various photosensitive members have been proposed which include the a-Si:Ge layer.

For example, Japanese Laid-Open Patent Application Nos. SHO 56-150753 and SHO 58-171039 and U.S. Pat. No. 4,491,626 propose to form an a-Si:Ge layer on a conductive substrate of a photosensitive member. However, these photosensitive members provide a problem that a quantity of carriers excited by short wavelength light in the vicinity of the surface, become substantially equal to that of carriers excited by long wavelength light in the vicinity of the substrate of the photosensitive member. As a result, both carriers move respectively to cross one another from the surface side to the substrate side and from the substrate side to the surface side in the a-Si:Ge layer of the photosensitive member. As both of these carriers have opposite polarities, polarity adjustment of the a-Si: Ge layer can be conducted by adding an impurity element, i.e. to adjust the transportability of holes and electrons. However, satisfactory result can not be obtained as it is generally difficult to ensure movability of both holes and electrons. Consequently, favorable transportability of carriers and suitable sensitivity are not attained. Moreover, a large thickness of the a-Si:Ge layer and a high Ge content to inhibit the interference of light hinder carriers excited by long wavelength light to move out of the a-Si:Ge layer as carriers are likely to be trapped in said layer, thereby causing reduction in sensitivity as well as in the charging capability due to many generation of excited carriers by the a-Si: Ge.

Further, other proposals have also been made to form the a-Si:Ge layer at the surface side of the photosensitive member in Japanese Patent No. SHO 56-150753 and U.S. Pat. No. 4,491,626. In these cases, a large thickness of the a-Si:Ge layer and a high Ge content in the layer to inhibit the interference of light hinder carriers excited by short wavelength light to move out of the a-Si:Ge layer thereby causing reduction in sensitivity as well as in the charging capability.

Also, U.S. Pat. No. 4,451,546 shows a photosensitive member having an a-Si layer, an a-Si:Ge layer formed on the a-Si layer and an a-Si layer formed on the a-Si:Ge layer. This photosensitive member connot absorb long wavelength light at a substrate side to a sufficient degree to thereby cause the interference of light.

As described above, a smaller band gap of a-Si:Ge compared with that of a-Si increases the absorbability toward long wavelength light to generate many carriers and improve sensitivity toward long wavelength light.

On the other hand, mere Ge doping makes a photosensitive member unworkable. For example, randomly high Ge doping increases a level of impurity elements in the band gap to thereby cause reduction of chargeability which should be said to the essence of photosensitive members. As a result, suitable electrostatic latent images cannot be obtained.

Moreover, a-Si:Ge has features of generating many carriers but conversely interfering the movement of the generated carriers. Accordingly, Ge content of meaninglessly high concentration as well as a large thickness of the a-Si:Ge layer hinder carriers to move to cause reduction in sensitivity and increase of residual potential. In addition, erasing of residual potential can not also be performed sufficiently to bring out unfavorable results for electrophotography such as generation of memory and so forth.

On the other hand, sufficient absorbability toward long wavelength light is required to inhibit the generation of the interference phenomena in electrophotography using coherent light as a light source such as in laser beam printers.

SUMMARY OF THE INVENTION

The primarily object of the present invention is to provide a photosensitive member free of the aforementioned disadvantages and having excellent properties for obtaining images of good qualities.

Another object of the present invention is to provide a photosensitive member having amorphous silicon:germanium layers which is free of reduction in sensitivity and optical fatigue, low in residual potential and excellent in chargeability.

Still another object of the present invention is to provide a photosensitive member having amorphous silicon: germanium layer which is capable of absorbing long wavelength light sufficiently to inhibit the generation of the interference phenomena in electrophotography using coherent light as a light source as in laser beam printers.

These and other objects of the prssent invention can be fulfilled by a photosensitive member which comprises a conductive substrate, a first layer composed substantially of amorphous silicon:germanium, a second layer formed on said first layer and composed substantially of amorphous silicon, and a third layer formed on said second layer and composed substantially of amorphous silicon:germanium.

DETAILED DESCRIPTION OF THE INVENTION

Figure 1:
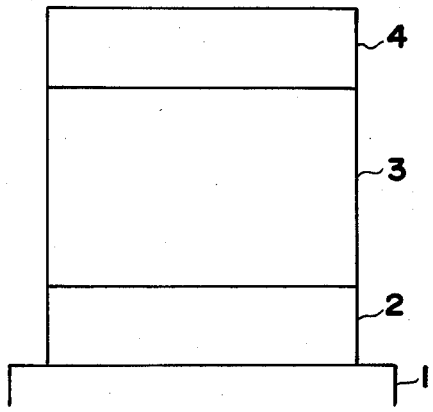
FIG. 1 shows a sectional view of the photosensitive member of the present invention.

FIG. 1 shows an embodiment of the photosensitive member of the present invention to illustrate the construction thereof. The photosensitive member comprises a conductive substrate (1), a first a-Si:Ge layer (2) formed on said substrate (1), an a-Si layer (3) formed on said first a-Si:Ge layer (2) and a second a-Si:Ge layer (4) formed on said a-Si layer. These three layers may include suitable hetero atoms respectively such as O,N,C,B,P etc. to improve chargeability and light sensitivity.

The photosensitive member of the present invention is constructed as a function separating type by assigning each layer the respective function. As described hereinafter, a transparent overcoated layer may be formed on said second a-Si: Ge layer, if necessary.

In the description hereinbelow, the compositions content of each layer is represented as follows; Ge content is represented in terms of percentile wherein the number of Ge atoms is divided by the total number of Si atoms and Ge atoms; B and P contents are represented by a volume ratio of $B_2H_6$ and $PH_3$ additive amounts relative to the $SiH_4$ amounts under a standard condition; and O (C,N,F) content is represented in terms of percentile wherein the number of O (C,N,F) atoms is divided by the total number of Si atoms and O (C,N,F) atoms.

Describing each layer from the side of incoming light, the second a-Si:Ge layer (4) has a thickness of about 4 μm or less, preferably 1 to 2.5 μm, and has a Ge content, composed substantially of a-Si:Ge, of about 40 atomic percent (hereinafter referred to as at %) or less, preferably 15 to 35 at %. This second a-Si:Ge layer (4) has a function of generating efficiently carriers upon light absorption. In other words, carriers are generated with efficiency toward long wavelength light (low energy light) of more than 600 to 700 nm due to a smaller band gap of the a-Si:Ge compared with that of a-Si. Accordingly, the photosensitive member exhibits improved sensitivity, especially toward long wavelength light.

In order to provide a function to prevent the interference phenomena in said second a-Si:Ge layer (4), an amount of Ge may be increased or the thickness to be increased. However, the increase of Ge content in turn causes the generation of excited carriers which is inherent in the a-Si:Ge to result in cause reduction of chargeability and in optical fatigue. On the other hand, the increase of the thickness of said layer increases trapping centers which is also a fundamental character of a-Si:Ge. These lead to trapping of carriers in said layer to result in reduction in sensitivity and generation of residual potential. Accordingly, the difficulty is encountered for said layer to have a function of preventing the interference phenomena. In this sense, said layer preferably has a Ge content of 40 at % or less and a thickness of 4 μm or less.

The above-mentioned second a-Si:Ge layer (4) preferably includes oxygen in the amount of about 0.05 to 5 at %, more preferably 0.1 to 2 at % to improve the chargeability of the photosensitive member, that is, to improve the dark resistance of said layer. If the amount of oxygen in said layer is less than 0.05 at %, the photosensitive member cannot obtain an improved chargeability, whereas the oxygen content above 5 at % results in considerable reduction in sensitivity. Further, the second a-Si:Ge layer (4) may have a carbon content of 0.1 to 10 at % for the same purpose as described above. The inclusion of oxygen together with carbon may have the effect in improving the chargeability. Moreover, as this second a-Si: Ge layer (4) is a carrier generating layer, holes or electrons generated in said layer are required to move efficiently and rapidly to the substrate side. Specifically, when the photosensitive member is charged positive, holes are required to move efficiently and when charged negative, electrons are required to move efficiently. For that purpose, said layer contains an impurity element in Group IIIA of the Periodic Table, particularly boron in an amount of 200 ppm or less (preferably 3 to 100 ppm) for the positive charging or an impurity element in Group VA of the Periodic Table, particularly phosphorous in an amount of 50 ppm or less (preferably 1 to 20 ppm ) for the negative charging. Therefore, a polarity adjustment is conducted to make the second a-Si:Ge layer (4) p-type by doping boron and to make said layer n-type by doping phosphorous. By this, efficient transportation of holes and electrons to the a-Si layer (3) is assured. More specifically, the polarity adjustment of the photosensitive member of the present invention is conducted by controlling the valence electrons so that when the photosensitive member is positively charged, charges of positive polarity serve as the majority carrier in the second a-Si: Ge layer (4) (p-type), or that when the member is negatively charged, charges of negative polarity serve as the majority carrier (n-type). Instead, the second a-Si:Ge layer (4) may be i-type or weak n-type and this is achieved without doping the impurity element of Group IIIA or Group VA of the Periodic Table since the thickness of said layer is small as 4 μm or less. Therefore, the impurity element is not required to be doped in said layer in spite of charging polarity.

The a-Si layer (3) has a thickness of 10 to 100 μm, preferably 20 to 45 μm, and has a function of transporting carriers generated in the second a-Si:Ge layer (4) to the substrate side with efficiency. While this a-Si layer (3) contributes to improve sensitivity by absorption of long wavelength light from the second a-Si:Ge layer, the absorption is small to generate only a limited amount of charge carriers. Accordingly, the fundamental function of the a-Si layer (3) is to transport carriers toward the substrate. In this connection, inclusion of Ge in the a-Si layer (3) may be considered to improve sensitivity, but contrarily carriers become more easily trapped due to a high density of trapping centers to thereby cause reduction in sensitivity, generation of residual potential and so forth. In this sense, said layer must be an a-Si layer without Ge.

The a-Si layer (3) may include as similar to the second a-Si:Ge layer (4) as described above, oxygen in the amount of about 0.05 to 5 at %, preferably 0.1 to 2 at % for the purpose of improving chargeability. Especially, this layer assures retaining of charges of the photosensitive member because of its large thickness of about 10 to 100 μm. If the oxygen content in the a-Si layer (3) is less than 0.05 at %, the improved dark resistance and chargeability of the photosensitive member cannot be achieved, whereas the oxygen content above 5 at % results in generation of residual potential as well as reduction in sensitivity. Further, not only oxygen but also carbon and/or nitrogen may be doped in said layer.

Moreover, the a-Si layer (3), in connection with its relatively large thickness as mentioned above, may further include an impurity element in Group IIIA of the Periodic Table, particularly boron for positive charging, or an impurity element in Group VA of the Periodic Table, particularly phosphorous for negative charging, for the purpose of assuring the transport of carriers to the substrate side with certainty. Boron content of about 200 ppm or less, preferably 3 to 100 ppm, or phosphorous content of about 50 ppm or less, preferably 1 to 20 ppm in the a-Si layer adjusts the polarity of said layer to transport holes or electrons with certainty.

The first a-Si:Ge layer (2) formed on the conductive substrate absorbs almost perfectly the transmitted light (mainly wavelength light) not absorbed by the above-mentioned second a-Si:Ge layer (4) and a-Si layer (3) to thereby prevent the generation of the interference phenomena. That is, the formation of the a-Si layer (3) in direct contact with the substrate without the formation of the first a-Si:Ge layer (4) causes the reflection of transmitted light at the surface of the substrate which in turn transmits the light back through the photosensitive member toward the surface of the member. The interference phenomena is more pronounced to cause the interference pattern to the copy image if a light source is a coherent light (for example, a semiconductor laser with wavelength of 780 nm or around).

Therefore, excellent absorbability toward light is required for the first a-Si:Ge layer (2) and in this regard, said layer has a Ge content of 10 at % or more, preferably 30 to 45 at % and a thickness of 0.05 μm or more, generally 2 to 3 μm. In addition, the generation of carriers in this layer accompanied with absorption of light is hardly attributed to sensitivity because carriers are generated in the vicinity of the substrate. Accordingly, Ge content can be increased without considering trapping. Specifically, Ge content of the above amount lowers the optical band gap in the first a-Si:Ge layer (2) to absorb light effectively.

The first a-Si:Ge layer (2), which functions as a light absorbing layer as mentioned above, also functions as a layer having the excellent ability to prevent the injection of charges from the substrate and as a layer with improved adhesion by doping an impurity element in Group IIIA or VA of the Periodic Table in addition to oxygen or carbon. More specifically, the first a-Si:Ge layer (2) is required to control to make the layer p-type or n-type relative to the charging polarity of the photosensitive member in order to prevent the injection of charges from the substrate (1). The reason is that the small optical band gap of the first a-Si:Ge layer (2) cannot avoid the injection of charges to the layer from the substrate (1). Therefore, boron is doped in the first a-Si:Ge layer (2) to make the layer p-type for the case of positive charging and phosphorous is doped to make the layer n-type for the negative charging in order to attain rectification. To describe in detail, when the photosensitive member of the present invention is negatively charged, the first a-Si:Ge layer (2) is made to n-type to prevent the injection of the positive charges from the substrate, and when the member is positively charged, the layer is made to p-type to prevent the injection of the negative charges from the substrate. The layer includes boron of 10 to 10000 ppm, preferably 100 to 500 ppm, and phosphorous of 5 to 200 ppm. Larger amounts of both boron and phosphorous in said layer than those in the bove-mentioned a-Si layer (3) and the second a-Si:Ge layer (4) give said layer a strong rectification, so that the photosensitive member attains improved chargeability and dark decay as well as the prevention of image disturbance based on the materials of the substrate.

The first a-Si:Ge layer (2) further includes oxygen or/and carbon in order to improve chargeability as well as adhesion to the substrate. Oxygen is contained in said layer in an amount of 1 to 15 at %, preferably 2 to 6 at %, and carbon is contained in an amount of 30 to 70 at %, preferably 45 to 55 at %. If the oxygen content is more than 15 at % and the carbon content is more than 70 at %, residual potential remarkably increases, while the oxygen content below 1 at % and the carbon content below 30 at % result in poor adhesion with the substrate. The layer may include oxygen and carbon separately or in combination with the amount same as described above.

As mentioned above the present photosensitive member basically comprises a conductive substrate, a first a-Si:Ge layer (2), an a-Si layer (3) formed on said a-Si:Ge layer (2) and a second a-Si:Ge layer (4) formed on said a-Si layer (3). However, an overcoat layer composed substantially of a-Si may be formed on the second a-Si:Ge layer (4) in order to improve chargeability as well as humidity resistance to which a-Si is weak. The overcoat layer has a thickness of 100 Å to 3 μm, preferably 0.1 to 0.5 μm, and includes at least one of the elements of C, N, O, F in addition to a-Si. More preferably the overcoat layer contains at least carbon in an amount of 30 to 70 at %. Further, said layer may include oxygen or nitrogen of 1 to 15 at %, or fluorine of 1 to 10 at %.

As described above, the first a-Si: Ge layer (2), the a-Si layer (3) and the second a-Si:Ge layer (4) may contain an impurity element in Group IIIA or VA of the Periodic Table respectively. However, the addition of impurity element is so controlled to make the first a-Si:Ge layer (2) and the a-Si layer (3) to have the same polarity of either p or n type, and the second a-Si:Ge layer (4) to have the intrinsic property or the same as the first a-Si:Ge layer (2) and the a-Si layer (3). That is, when the photosensitive member is charged positive, boron is included in each layer to make the layers p-type, whereas when the member is charged negative, phophorous is contained to make the layers n-type. However, the second a-Si: Ge layer (4) is not required to include the impurity elements as described above.

The photosensitive member according to the present invention can be produced by any known method, for example, by the use of a glow discharge decomposition apparatus. Specifically, the conductive substrate preheated to a temperature of 100° to 300° C. is disposed in a reactor chamber, wherein gases are introduced which include silicon gases such as $SiH_4$ and $Si_2H_6$, and germanium gases such as $GeH_4$ and $Ge_2H_6$ with suitable carrier gases such as $H_2$ and Ar and, if required, $B_2H_6$, $PH_3$, $O_2$ and $C_2H_4$ gases. Then, glow discharge is effected by applying a high frequency power between the substrate and the surrounding electrode. By this, the first a-Si:Ge layer (2) is formed on the substrate followed by forming the a-Si layer (3) and the second a-Si:Ge layer (4) with the introduction of the selected gases.

As apparent from the above-mentioned description, the photosensitive member of the present invention has improved sensitivity toward long wavelength light and excellent chargeability, and is free of residual potential and interference phenomena. Especially, the present photosensitive member is free of interference phenomena in an image forming method using coherent light as a light source such as laser beam printers, as almost full absorbtion of long wavelenght light is achieved.

EXAMPLE 1

Figure 2:
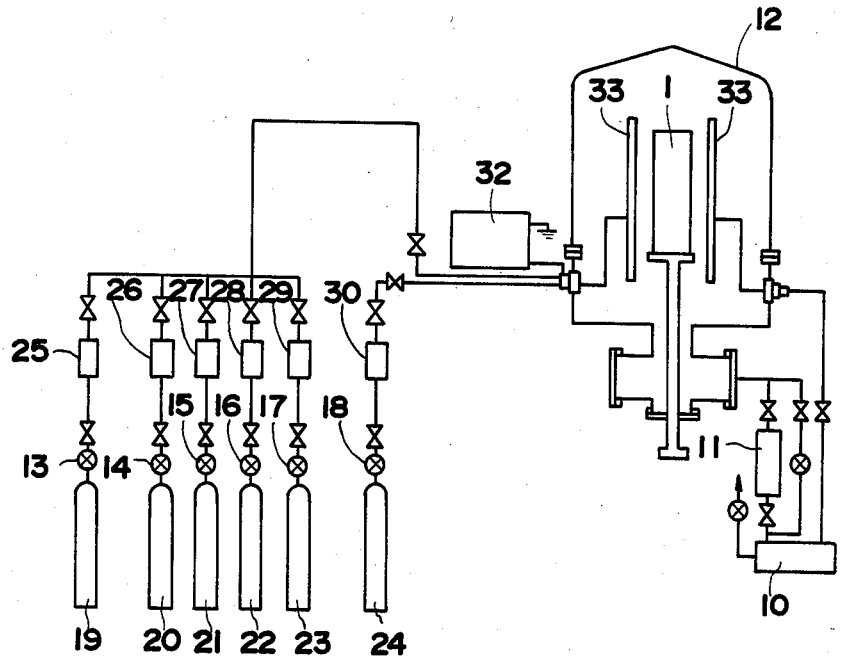
FIG. 2 is a diagram showing a glow discharge decomposition apparatus for producing the photosensitive member of the present invention.

Step (1):

With reference to FIG. 2 showing a glow discharge decomposition apparatus, first a rotary pump (10) and then a diffusion pump (11) were operated to evacuate the interior of a reaction chamber (12) to a high vacuum of about $10^{-6}$ Torr. Thereafter, first to fourth and sixth regulator valves (13), (14), (15), (16), (17) and (18) were opened to introduce $H_2$ gas from a first tank (19), 100% $SiH_4$ gas from a second tank (20), $B_2H_6$ gas diluted to 200 ppm with $H_2$ from a third tank (21), 100% $GeH_4$ gas from a fourth tank (22) and 100% $O_2$ gas from a sixth tank (24), with each output pressure gauge adjusted to 1.5 kg/cm$^2$, into mass flow controllers (25), (26), (27), (28) and (30) respectively. Then, with the mass flow controllers adjusted to a flow rate of 365 sccm for $H_2$, 100 sccm for $SiH_4$, 100 sccm for $B_2H_6/H_2$, 20 sccm for $GeH_4$ and 15 sccm for $O_2$, the gases were introduced into the reactor chamber (12). After the stabilization of each flow rate, the internal pressure of a reactor chamber (31) was adjusted to 1.0 Torr. On the other hand, an aluminum drum was employed as an electrically conductive substrate (1). The aluminum drum, 80 mm in diameter, was preheated to 250° C. After the stabilization of each gas flow rate and the internal pressure, a high frequency power source (32) was turned on to apply a power of 250 watts (frequency : 13.56 MHz) to a cylindrical electrode (33) to cause glow discharge. This glow discharge was continued for about 40 minutes to form on the substrate (1) a first a-Si:Ge photosensitive layer (2) having a thickness of about 2 μm and containing hydrogen, boron and a trace amount of oxygen.

A germanium content of this layer was about 30 at %.

Step (2):

When the first a-Si:Ge photosensitive layer was formed, the power application from the high frequency power source (32) was stopped, while the flow rate of the mass flow controller was adjusted to 0 to fully degas the reaction chamber (12). Thereafter, gases were introduced into the reaction chamber, i.e., $H_2$ gas from the first tank (19) at 383 sccm, 100% $SiH_4$ gas from the second tank (20) at 200 sccm, $B_2H_6$ gas diluted to 200 ppm with $H_2$ at 15 sccm from the third tank (21) and $O_2$ gas from the sixth tank (24) at 2 sccm. Then, after the adjustment of the internal pressure to 1.0 Torr, the high frequency power source was turned on to apply a power of 300 watts. This glow discharge was continued for about 5 hours to form an a-Si layer (3) having a thickness of about 35 μm .

Step (3):

When the a-Si layer was formed, the power application from the high frequency power source (32) was again stopped, while the flow rate of the mass flow controller was adjusted to 0 to fully degas the reactor chamber.

Subsequently, the gases are introduced into the reactor chamber, i.e., $H_2$ gas from the first tank (19) at 479 sccm, 100% $SiH_4$ gas from the second tank (20) at 100 sccm, $B_2H_6$ gas diluted to 200 ppm with $H_2$ from the third tank (21) at 5 sccm, $GeH_4$ gas from the fourth tank (22) at 15 sccm and $O_2$ gas from the sixth tank (24) at 1 sccm. With the internal pressure adjusted to 1.0 Torr, the high frequency power source was turned on to apply a power of 250 watts. This discharge was continued for about 40 minutes to form an a-Si:Ge layer (4) having a thickness of about 2 μm and containing about 24 at % of germanium.

The photosensitive member thus obtained is referred to as the photosensitive member A hereinafter. The photosensitive member A was set in a copying machine of the toner image transfer type (Model EP650Z, product of Minolta Camera Kabushiki Kaisha) and used for copying with charging polarity of positive. Sharp copy images were obtained with a high density, high resolution and good tone reproducibility. After 50,000 continual copying cycle, satisfactory copies were further obtained which were free of the degradation in image characteristics.

Moreover, the photosensitive member A was used for a laser beam printer with a semiconductor laser as a light source. Even under the high-speed printing condition, sharp and high-quality images were obtained which were free of density variance in the images due to the conventional interference phenomena.

COMPARATIVE EXAMPLE 1

The photosensitive member P was obtained in the same manner as in Example 1 with the Step (3) omitted.

COMPARATIVE EXAMPLE 2

The photosensitive member Q was obtained in the same manner as in Example 1 with the Step (1) omitted.

Figure 3:
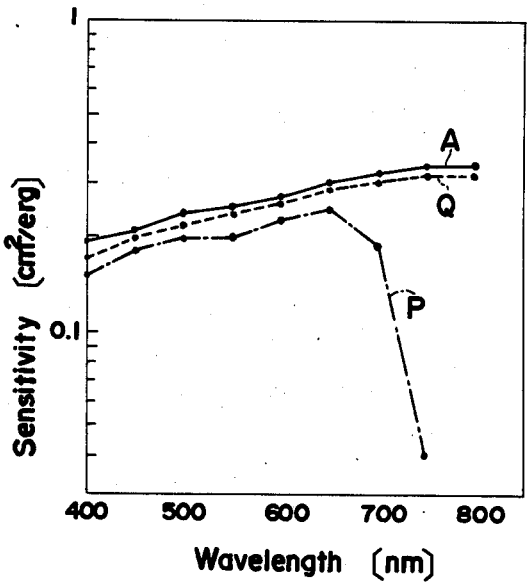
FIG. 3 shows the spectral sensitivity of the present photosensitive member and conventional photosensitive members.
Figure 4:
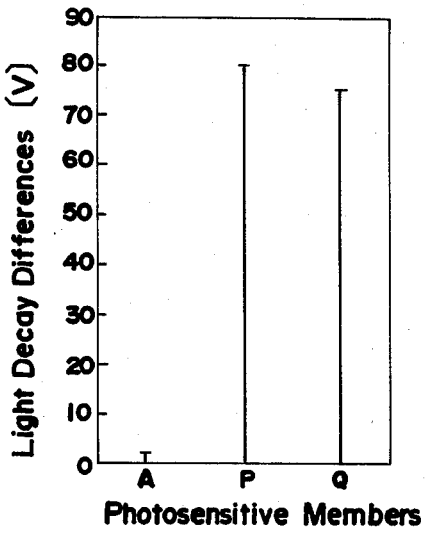
FIG. 4 shows light decay potentials of the present photosensitive member and the conventional photosensitive members.

The photosensitive member P and Q thus obtained correspond to the member shown in FIG. 1 without the second a-Si:Ge layer (4) and the first a-Si:Ge layer (2) respectively. FIG. 3 shows the spectral sensitivity of the photosensitive members A, P and Q thus obtained. With reference to FIG. 3, the ordinate shows the area (cm$^2$) capable of light decaying a potential of 600 V charged on the photosensitive member to 150 V by light energy of 1 erg, and this corresponds to sensitivity. Moreover, the photosensitive members A, P and Q charged to 600 V by corona discharge were irradiated with a semiconductor laser light (wavelength: about 780 nm, strength: 15 ergs/cm$^2$) and measured the potentials respectively after light decay. FIG. 4 shows the results of the measured potentials respectively. In FIG. 4, the ordinate indicates the fluctuating potential value of the respective photosensitive members after light decay depending upon the areas, which correspond to the differences between the sensitivity in light portions and that in dark portions. The photosensitive member A exhibits improved sensitivity according to FIG. 3, and is free of potential fatigue caused by the interference phenomena according to FIG. 4.

EXAMPLE 2

Step (4):

Step (1) to Step (3) were repeated under the same condition as Example 1. Subsequently, the power application from the high frequency power source (32) was stopped, while the flow rate of the mass flow controller was adjusted to 0 to fully degas the reaction chamber (12). Thereafter, the gases were introduced into the reaction chamber, i.e., $H_2$ gas from the first tank (19) at 350 sccm, 100% $SiH_4$ gas from the second tank (20) at 30 sccm and $C_2H_4$ gas from a fifth tank (23) at 120 sccm. With the internal pressure adjusted to 1.0 Torr, the high frequency power source was turned on to apply a power of 250 watts. This discharge was continued for about 9 minutes to form an a-Si:C layer having a thickness of about 0.1 μm and a carbon content of obout 60 at %. Specifically, with reference to FIG. 1, an a-Si overcoat layer including carbon was formed on the second a-Si:Ge layer (4). The photosensitive member thus obtained is referred to B herinbelow. The photosensitive member was further used for copying under the high-temperature and high-humidity conditions of 30° C., 85%, but no differences in electrophotographic characteristics of the member and copy image quality were observed with those at the room-temperature conditions.

EXAMPLE 3

The photosensitive member C was obtained by repeating Steps (1), (2) and (3) except for introducing $C_2H_4$ gas at 240 sccm instead of $O_2$ gas and for setting $H_2$ gas to 140 sccm at Step (1). With reference to the photosensitive member C, about 45 at % of carbon was included in the first a-Si: Ge layer formed at Step (1).

EXAMPLE 4

The photosensitive member D was prepared by repeating Steps (1), (2) and (3) to form each layer except for changing the flow amounts of $O_2$ gas and $H_2$ gas to 10 sccm and 270 sccm respectively and further introducing $C_2H_4$ gas at 100 sccm at Step (1).

COMPARATIVE EXAMPLE 3

The photosensitive member R was obtained by repeating Steps (1), (2) and (3) to form each layer except for changing the flow amounts of $O_2$ gas and $H_2$ gas to 1 sccm and 379 sccm respectively at Step (1). The photosensitive member R had an oxygen content of about 0.4 at %.

COMPARATIVE EXAMPLE 4

The photosensitive member S was prepared by repeating Steps (1), (2) and (3) to form each layer except for introducing $C_2H_4$ gas at 15 sccm instead of $O_2$ at Step (1). The photosensitive member S had a carbon content of about 10 at %.

The photosensitive members C, D, R and S thus obtained were left in the condition of temperature at 30° C. and humidity at 80% for 24 hours to evaluate the adhesion of the members respectively. Table 1 shows the results. The first a-Si:Ge layer of the present invention exhibits excellent adhesion according to Table 1.

TABLE 1

| Photosensitive member | C | D | R | S |
|---|---|---|---|---|
| Adhesive Condition | o | o | Δ | x |

o: adhere
Δ: partly exfoliate
x: fully exfoliate

What is claimed is:

1. A photosensitive member which comprises:

a conductive substrate;

a first amorphous silicon: germanium layer having a thickness of more that about 0.05 μm and including oxygen and/or carbon, more than about 10 atomic % of germanium and about 10 to 10,000 ppm of an impurity element in Group IIIA of the Periodic Table or about 5 to 200 ppm of an impurity element in Group VA of the Periodic Table;

an amorphous silicon layer formed on the first amorphous silicon: germanium layer and having a thickness of about 10 to 100 μm, said amorphous silicon layer including oxygen and less than about 200 ppm of an impurity element in Group IIIA of the the Periodic Table or less than about 50 ppm of an impurity element in Group VA of the Periodic Table; and a second amorphous silicon: germanium layer formed on said amorphous silicon layer and having a thickness of from about 1 to 4 μm, said second amorphous silicon: germanium layer including oxygen and/or carbon and less than about 40 atomic % of germanium.

2. A photosensitive member as claimed in claim 1 wherein said amorphous silicon layer includes about 0.05 to 5 atomic % of oxygen.

3. A photosensitive member as claimed in claim 1 wherein said first amorphous silicon: germanium layer includes about 1 to 15 atomic % of oxygen and/or about 30 to 70 atomic % of carbon.

4. A photosensitive member as claimed in claim 1 wherein said second amorphous silicon: germanium layer includes about 0.05 to 5 atomic % of oxygen or about 10 to 60 atomic % of carbon.

5. A photosensitive member as claimed in claim 1 wherein an impurity element in Group IIIA of the Periodic Table is boron.

6. A photosensitive member as claimed in claim 1 wherein an impurity element in Group VA of the Periodic Table is phosphorous.

* * * * *